US010859233B2

(12) United States Patent
Ruckebusch

(10) Patent No.: US 10,859,233 B2
(45) Date of Patent: Dec. 8, 2020

(54) OPTICAL MODULE FOR A VEHICLE HEADLAMP

(71) Applicant: VALEO VISION, Bobigny (FR)

(72) Inventor: Nicolas Ruckebusch, Courchelettes (FR)

(73) Assignee: VALEO VISION, Bobigny (FR)

( * ) Notice: Subject to any disclaimer, the term of this patent is extended or adjusted under 35 U.S.C. 154(b) by 47 days.

(21) Appl. No.: 16/052,160

(22) Filed: Aug. 1, 2018

(65) Prior Publication Data

US 2018/0340667 A1 Nov. 29, 2018

Related U.S. Application Data

(63) Continuation of application No. 14/991,097, filed on Jan. 8, 2016, now Pat. No. 10,072,810.

(30) Foreign Application Priority Data

Jan. 9, 2015 (FR) ..... 15 50174

(51) Int. Cl.

| | |
|---|---|
| ***F21S 45/43*** | (2018.01) |
| ***F21S 45/49*** | (2018.01) |
| ***F21V 17/16*** | (2006.01) |
| ***F21Y 115/10*** | (2016.01) |
| ***F21S 41/148*** | (2018.01) |

(52) U.S. Cl.

CPC ..... *F21S 45/43* (2018.01); *F21S 45/49* (2018.01); *F21V 17/16* (2013.01); *F21S 41/148* (2018.01); *F21Y 2115/10* (2016.08)

(58) Field of Classification Search

CPC ..... F21S 41/147; F21S 45/43; F21S 45/49; F21S 45/42; F21S 45/47; F21V 17/16; F21V 29/60; F21V 29/767; F21V 21/088; F21Y 2115/10

See application file for complete search history.

(56) References Cited

U.S. PATENT DOCUMENTS

| | | | | |
|---|---|---|---|---|
| 5,083,253 | A | 1/1992 | Hahnel | |
| 5,664,872 | A | 9/1997 | Spearman et al. | |
| 7,150,311 | B2 * | 12/2006 | Liu | H01L 23/4093 165/80.3 |
| 7,547,123 | B2 | 6/2009 | Kittredge et al. | |
| 7,572,033 | B2 | 8/2009 | Sun et al. | |
| 8,040,674 | B2 | 10/2011 | Chen et al. | |
| 8,118,462 | B2 | 2/2012 | Inoue et al. | |
| 8,203,274 | B2 | 6/2012 | De Castro | |
| 9,008,534 | B2 | 4/2015 | Yuasa | |
| 9,134,003 | B2 | 9/2015 | Inoue et al. | |
| 9,255,687 | B2 | 2/2016 | Gebhard et al. | |

(Continued)

FOREIGN PATENT DOCUMENTS

| | | |
|---|---|---|
| EP | 2 138 759 A1 | 12/2009 |
| EP | 2 679 883 A2 | 1/2014 |
| WO | 2015/051887 A1 | 4/2015 |

*Primary Examiner* — Peggy A Neils

(74) *Attorney, Agent, or Firm* — Oblon, McClelland, Maier & Neustadt, L.L.P.

(57) ABSTRACT

An optical module including a heat sink having one or more heat dissipating surfaces, a fan for sending air over said one or more heat dissipating surfaces, and a light source held by said heat sink. The main feature of an optical module according to the invention is that the fan is mounted on the heat sink by clipping.

19 Claims, 3 Drawing Sheets

(56) References Cited

U.S. PATENT DOCUMENTS

| | | | | |
|---|---|---|---|---|
| 9,328,892 | B2 | 5/2016 | Matsumoto | |
| 9,593,821 | B2 | 3/2017 | Thullier et al. | |
| 10,060,617 | B2 * | 8/2018 | Horng | F21V 15/01 |
| 10,072,810 | B2 * | 9/2018 | Ruckebusch | F21V 17/16 |
| 2012/0038272 | A1 * | 2/2012 | De Castro | F21S 41/255<br>315/35 |
| 2015/0252995 | A1 * | 9/2015 | Jestel | F21V 29/677<br>362/249.01 |
| 2017/0370551 | A1 | 12/2017 | Ruckebusch | |

* cited by examiner

OPTICAL MODULE FOR A VEHICLE HEADLAMP

CROSS-REFERENCE TO RELATED APPLICATIONS

This application is a Continuation of U.S. patent application Ser. No. 14/991,097, filed Jan. 8, 2016, which claims priority to the French application 1550174 filed Jan. 9, 2015, which application is incorporated herein by reference and made a part hereof.

BACKGROUND OF THE INVENTION

1. Field of the Invention

The invention relates to an optical module for a vehicle headlamp.

2. Description of the Related Art

Generally, such an optical module works with a light source having the drawback of emitting heat. It is therefore equipped with a heat sink to absorb the heat in order to keep the temperature of the module at a relatively low level. In this way, the operation of the optical module is not affected by too high a temperature.

This type of module has already been patented. For example, patent application EP 2 138 759, which is equivalent to U.S. Publication 2009/0316425, now issued as U.S. Pat. No. 8,118,462, relates to an optical module with the particularity of having a light source based on a semiconductor light emitting device. This module comprises a heat sink for blowing cooled air toward the light source.

SUMMARY OF THE INVENTION

An optical module according to the invention uses a fan/heat sink assembly which is easy and quick to assemble and disassemble, and which is compact and inexpensive.

The invention relates to an optical module comprising a heat sink having one or more heat dissipating surfaces, a fan for sending air over the one or more heat dissipating surfaces, and a light source held by the heat sink.

The main feature of an optical module according to the invention is that the fan is mounted on the heat sink by clipping. In this way, the fan may be mounted on the heat sink quickly and easily because it does not need any special tools or complicated gestures requiring precision and rigor. In addition, the fan may be removed from the heat sink at any time as quickly and easily as when it was mounted on the heat sink. The fan is oriented relative to the heat sink, so that the air forced by the fan passes between the heat dissipating surfaces of the heat sink. It is advantageously assumed that the heat dissipating surfaces of the heat sink are made of metal. The heat sink can hold the light source, either directly or indirectly by means of a holding part. Each heat dissipating surface may, for example, take the form of a fin or a stud.

Advantageously, the heat sink comprises a housing having one or more edges and at least two deformable clipping tabs projecting from the edge or from at least two of the edges, the fan being placed on the heat sink between the at least two clipping tabs. Thus, the fan is mounted on the heat sink in two stages, the first stage comprising bringing the fan close to the heat sink, causing the clipping tabs to move apart elastically, and then in the second stage the clipping tabs close over the fan once the latter has reached its final mounting position on the heat sink. The tabs naturally close over the fan as they try to return to the relaxed position thereof. It is assumed that all the clipping tabs project from the edges in the same direction. In this embodiment, the fan is mounted on the heat sink from the top.

Preferably, the housing has two clipping tabs projecting from two opposite edges facing one another. This is a simple configuration ensuring a uniform and effective anchoring of the fan on the heat sink.

Preferably, each clipping tab has three segments and two bends, the distance between the tabs being less than the dimensions of the fan so that the fan is mounted on the heat sink by virtue of the tabs moving apart.

Advantageously, the two tabs are inclined with respect to one another so as to facilitate insertion of the fan. Thus, the two tabs are oriented with respect to one another to form a bottleneck which narrows gradually in the direction of the heat sink, thus facilitating the prepositioning of the fan relative to the heat sink, and then guiding it in translational movement to bring it closer to the heat sink.

Advantageously, each edge has at the top at least one fan positioning member projecting from the housing in the same direction as the clipping tabs.

Preferably, each positioning member consists of a flat wall extending each edge of the housing of the heat sink in the same plane.

Advantageously, the heat sink has a plurality of dissipating surfaces formed by parallel fins. Advantageously, the fins are all the same size and are strictly aligned. Each of the fins may advantageously take the form of a metal sheet.

Preferably, the fins are separated from one another. They thus constitute a discontinuous array, two successive fins being separate and independent from one another.

According to another preferred embodiment of an optical module according to the invention, the fins are continuous with one another to form a single piece. Preferably, two successive fins are joined to one another by a 180° bend. Thus arranged, the fins constitute a single piece that can be easily manipulated in order, for example, to insert it in the housing of the heat sink so as to mount it therein.

Preferably, the fins are made of aluminum. As the fins take the form of sheets they may thus be made of 99% pure aluminum, in contrast to existing heat sinks made from a die-cast aluminum alloy, which is less efficient in terms of cooling.

Advantageously, the light source comprises at least one light emitting diode. A light emitting diode is a compact light source which is nonetheless efficient in terms of light intensity.

According to another preferred embodiment of an optical module according to the invention, the fan is mounted on the heat sink by sliding the fan along the heat sink and then locking by clipping. This is an alternative embodiment of a light module according to the invention, wherein the fan is mounted laterally on the heat sink.

Advantageously, sliding is effected through interaction between two grooves and two rails, the two grooves belonging to one of the two elements consisting of the heat sink and the fan, and the two rails belonging to the other element. In other words, if the two rails belong to the fan, then the grooves belong to the heat sink, and vice versa. The grooves are inserted in the rails and slide along the latter until the fan reaches its final mounting position.

The invention also relates to a heat sink for producing an optical module according to the invention.

The invention further relates to a vehicle headlamp comprising at least one optical module according to the invention. Indeed, a light module according to the invention is particularly suitable for use in a vehicle headlamp, in particular in a motor vehicle headlamp.

An optical module according to the invention has the advantage of flexibility of use and maintenance, because the fan can be mounted on the heat sink quickly and easily, and can be removed at any time just as easily. It has the additional advantage of being efficient in terms of temperature control, insofar as the heat sink is made of folded sheet metal, with pure aluminum having good thermal conduction.

These and other objects and advantages of the invention will be apparent from the following description, the accompanying drawings and the appended claims.

BRIEF DESCRIPTION OF THE ACCOMPANYING DRAWINGS

Two preferred embodiments of an optical module according to the invention are described in detail below, with reference to FIGS. 1 to 6.

DETAILED DESCRIPTION OF THE PREFERRED EMBODIMENTS

Figure 1:
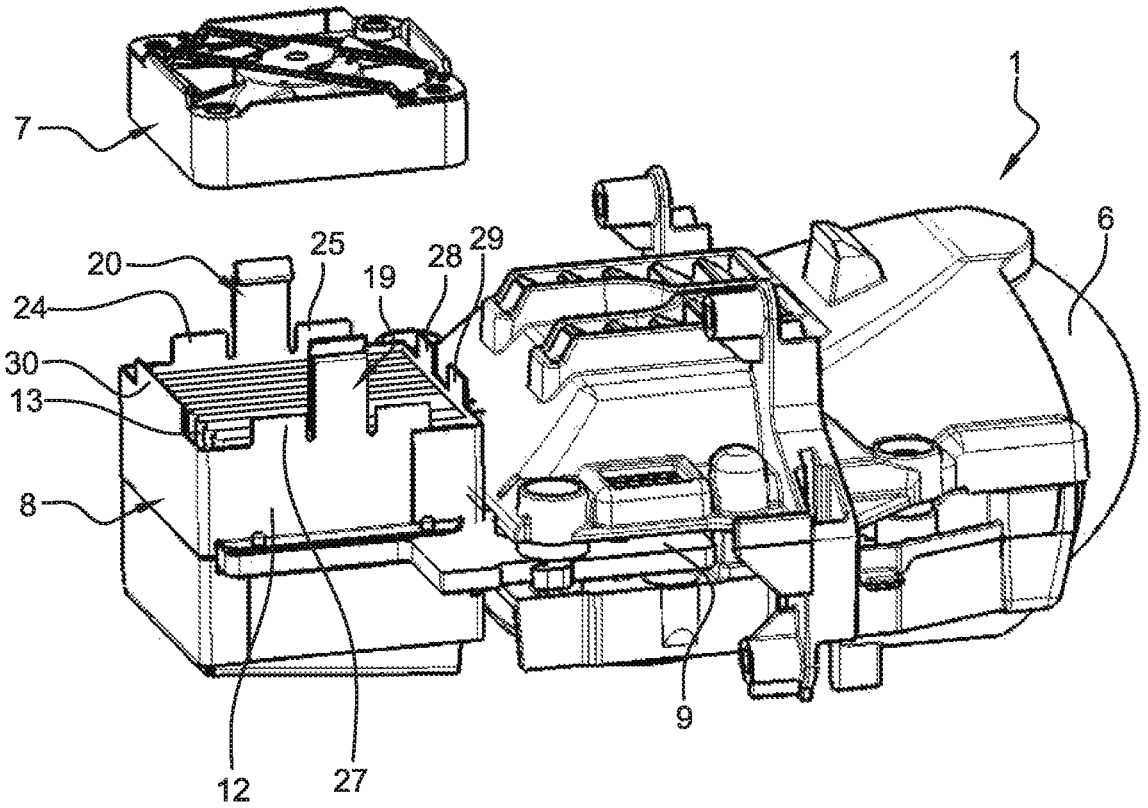
FIG. 1 is a perspective view of an optical module according to the invention, with the fan detached from the module.
Figure 2:
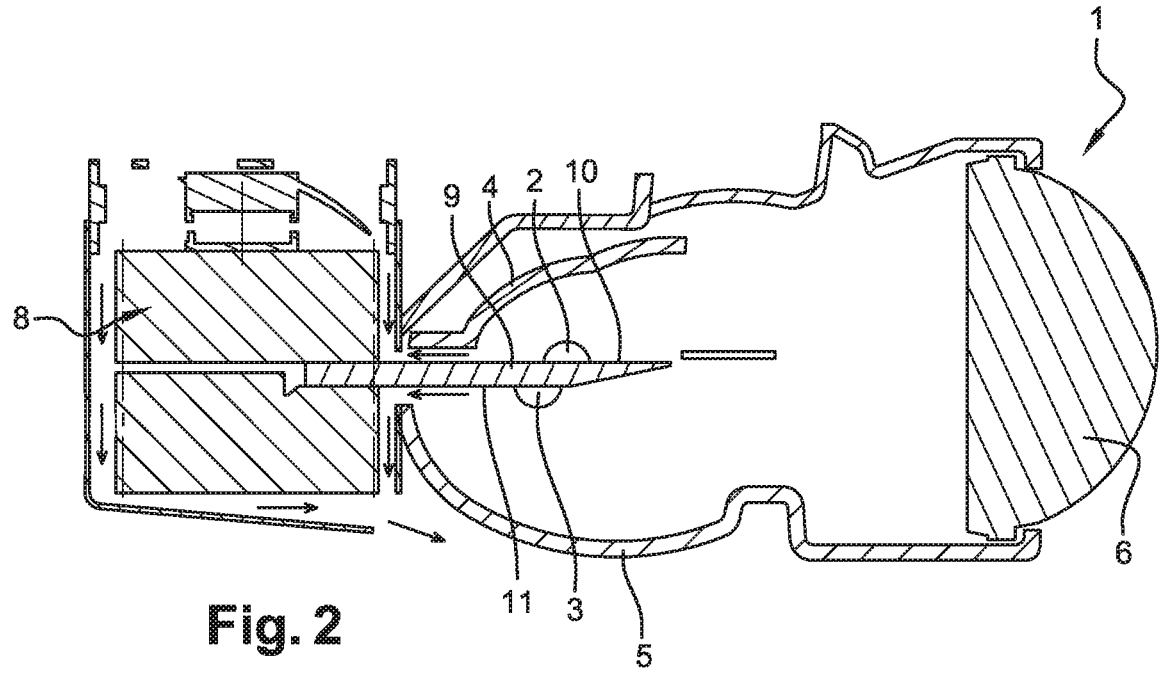
FIG. 2 is a view in section of the module of FIG. 1.

Referring to FIGS. 1 and 2, an optical module 1 according to the invention is an elongate element, and schematically comprises two light emitting diodes 2, 3, two reflective optical surfaces 4, 5, an exit refractive surface 6 and a cooling device having a fan 7 and a heat sink 8. The two light-emitting diodes 2, 3 are placed on a thin flat support piece 9 which is rigidly secured to the heat sink 8. More specifically, the support piece 9 comprises two parallel flat surfaces 10, 11, a light-emitting diode 2, 3 being secured to each of the flat surfaces 10, 11. Each reflective optical surface 4, 5 is curved and is positioned facing a light-emitting diode 2, 3 so as to reflect the light beams from the light-emitting diode 2, 3 toward the exit refractive surface 6. The cooling device or fan 7 is placed behind the light-emitting diodes 2, 3 with respect to the exit refractive surface 6. In other words, the light-emitting diodes 2, 3 are placed between the exit refractive surface 6 and the assembly formed by the cooling device or fan 7 and the heat sink 8. The cooling device or fan 7, the light-emitting diodes 2, 3 and the exit refractive surface 6 are aligned along a longitudinal axis of the optical module 1.

Figure 3:
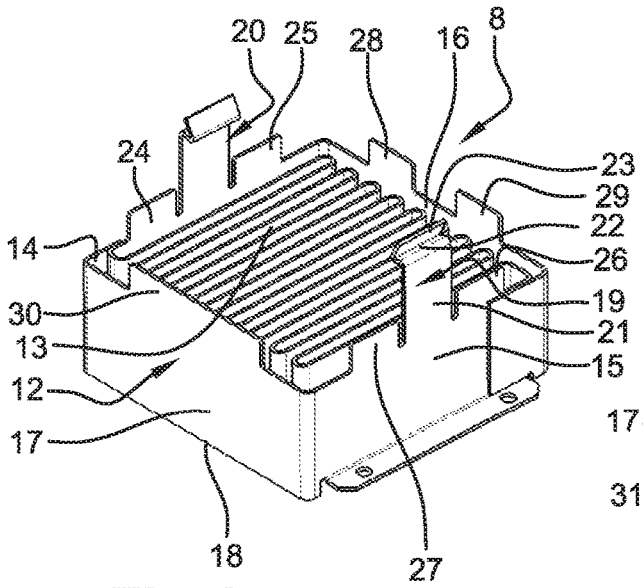
FIG. 3 is a perspective view of a heat sink of an optical module according to the invention.
Figure 4:
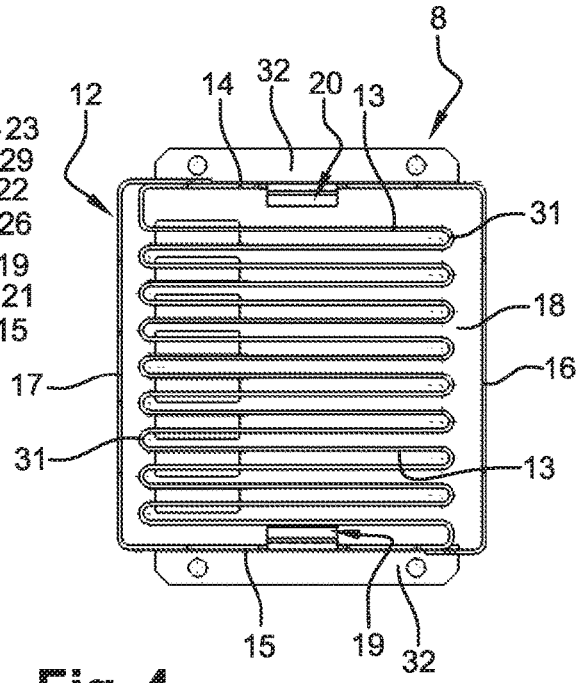
FIG. 4 is a top view of the heat sink of FIG. 3.

Referring to FIGS. 3 and 4, the heat sink 8 comprises a housing 12 and an array of fins 13 made of aluminum. The housing 12 is delimited by four side walls 14, 15, 16, 17 and by a bottom 18, two successive walls making an angle of 90° between them. The side walls 14, 15, 16, 17 and the bottom 18 are flat, the bottom 18 being perpendicular to each of the side walls 14, 15, 16, 17.

Figure 5:
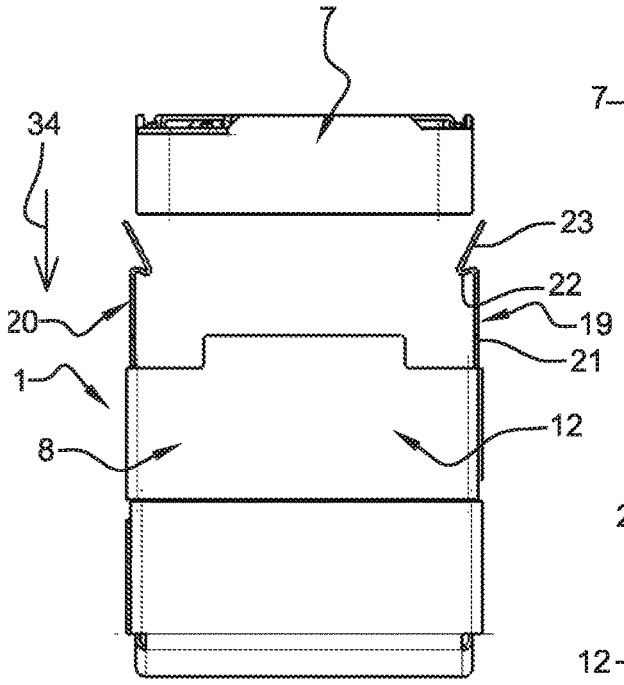
FIG. 5 is an exploded view of a portion of a first preferred embodiment of an optical module according to the invention.

Referring to FIGS. 3 and 5, two parallel side walls 14, 15 of the housing 12 are each extended by an elastically deformable clipping tab 19, 20, each of the clipping tabs 19, 20 having three segments 21, 22, 23 and two bends. These two clipping tabs 19, 20 emerge from the same side of the two side walls 14, 15 on which they are located, the side being opposite to that on which the bottom 18 is located. Thus, each clipping tab 19, 20 extends in a direction which is opposite to that in which the bottom 18 is located. The first segment 21 extends, in the same plane, the side wall 14, 15 from which it emerges, the second segment 22 extends the first segment 21 and tends toward the center of the housing 12. The third segment 23 extends the second segment 22, being slightly inclined relative to the first segment 21, and tends toward the outside of the housing 12, the two bends being located between the three segments 21, 22, 23. The third segment 23 of the two facing clipping tabs 19, 20 define between them a space which progressively decreases as it approaches the bottom 18 of the housing 12. Two positioning tabs 24, 25, 26, 27 flank each of the two clipping tabs 19, 20, each of the positioning tabs 24, 25, 26, 27 being constituted by a thin flat wall, extending, in the same plane, the side wall 14, 15 of the housing 12 from which it emerges, and projecting in the same direction as the clipping tabs 19, 20. The other two parallel side walls 16, 17 of the housing 12 also have positioning tabs 28, 29, 30 having different lengths along the side walls 16, 17. The various positioning tabs 24, 25, 26, 27, 28, 29, 30 are intended to delimit a space in the heat sink 8 for receiving the cooling device or fan 7.

Referring to FIGS. 3 and 4, the array of fins 13 of the heat sink 8 are all the same length and are arranged in the heat sink 8 parallel to one another. They are also aligned with one another, two successive array of fins 13 being joined to one another by a segment 31 bent by 180°. In other words, each array of fins 13 is extended at the ends thereof by segments 31 bent in opposite directions. As the array of fins 13 are machined sheets, they may be made of 99% pure aluminum, thus ensuring efficient thermal conduction, in particular for cooling the optical module 1. The array of fins 13 of the heat sink 8 form a single piece which is received in the housing 12 of the heat sink 8, being totally enclosed in the housing 12, without emerging therefrom. The housing 12 has perforated fastening means 32, parallel to the bottom 18 of the housing 12, to enable it to be secured for example by screwing to the flat support piece 9 of the optical module 1.

Referring to FIG. 5, according to a first preferred embodiment of an optical module 1 according to the invention, the array of fins 13 and the housing 12 form a single piece made of folded sheet aluminum. The cooling device or fan 7 is positioned over the heat sink 8, consisting of the housing 12 and the array of fins 13, the heat sink 8 being secured to the flat support piece 9 of the optical module 1. The cooling device or fan 7 is then moved downward in translation, as indicated by the arrow 34, so as to be mounted on the heat sink 8. The cooling device or fan 7 thus passes between the third segments 23 of the two clipping tabs 19, 20, causing the two clipping tabs 19, 20 to move apart temporarily. The cooling device or fan 7 continues on its path toward the heat sink 8 until the top of the cooling device or fan 7 has passed the second segments 22 of the tabs 19, 20. The clipping tabs 19, 20 then close over the cooling device or fan 7 as they relax into the rest position thereof.

Figure 6:
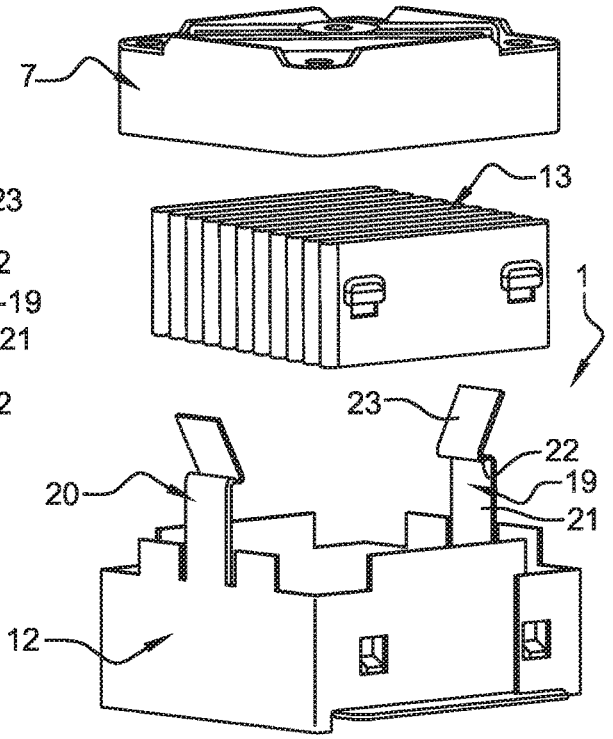
FIG. 6 is an exploded view of a portion of a second preferred embodiment of an optical module according to the invention.
Figure 7:
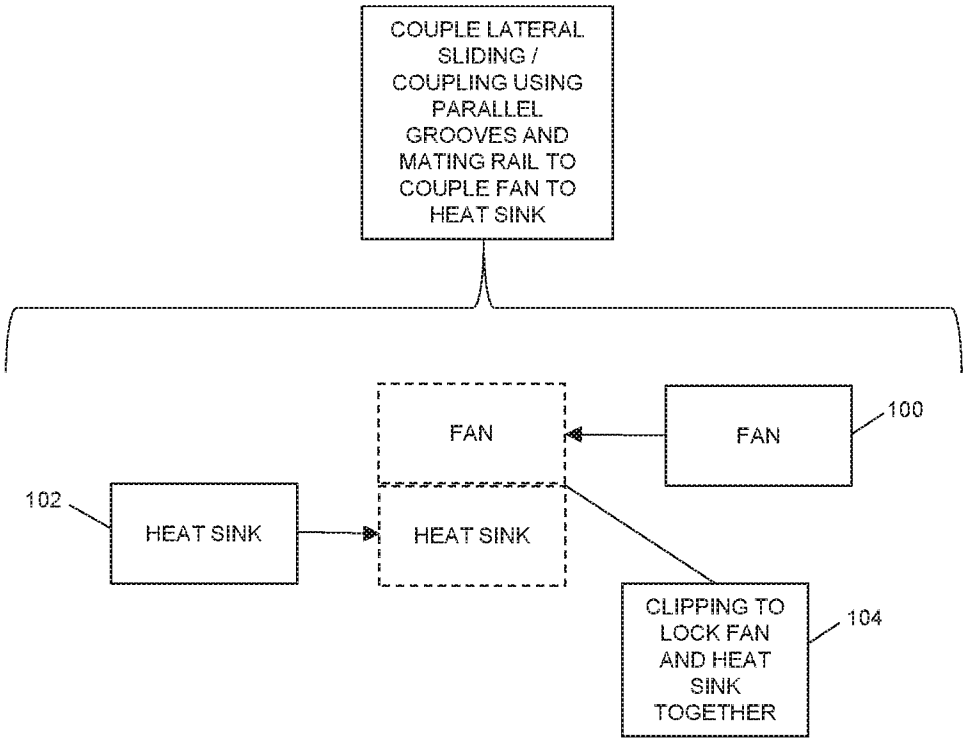
FIG. 7 is an exploded view of a portion of a third preferred embodiment of an optical module according to the invention.

Referring to FIG. 6, according to a second preferred embodiment of an optical module 1 according to the invention, the array of fins 13 and the housing 12 are two separate pieces made of folded sheet aluminum. The piece forming the array of fins 13 is thus pre-inserted into the housing 12 to form the heat sink 8. The cooling device or fan 7 is then mounted on the heat sink 8 according to the same principle as used for the first preferred embodiment described above.

According to a third preferred embodiment of an optical module 1 according to the invention, the cooling device or fan 7 may be mounted not via the top of the heat sink 8 as is the case in the first two preferred embodiments described above, but laterally by sliding on the heat sink 8. The lateral sliding is effected by interaction between two parallel projecting grooves and two parallel rails, the grooves belonging to either of the two elements consisting of the cooling device or fan 7 and the heat sink 8, and the two rails belonging to the other element. The grooves are inserted in the rails, and the cooling device or fan 7 slides laterally on the heat sink 8, creating an extra thickness corresponding approximately to the total thickness of the fan. At the end of its path, the cooling device or fan 7 is locked to the heat sink 8 by clipping.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical module comprising:

a heat sink having one or more heat dissipating surfaces;

a fan for sending air over said one or more heat dissipating surfaces;

a light source held by said heat sink, said fan mounted on said heat sink by clipping;

a flat support piece; and a heat sink housing adapted to be mounted on and receive said heat sink, wherein said heat sink is secured to the flat support piece, and said heat sink housing has a fastening perforation, parallel to a bottom of said heat sink housing, to allow said heat sink housing to be secured to said flat support piece with at least one screw.

2. The optical module according to claim 1, wherein the heat sink housing comprises one or more edges and at least two deformable clipping tabs projecting from at least one of said one or more edges, and said fan is placed on said heat sink between said at least two deformable clipping tabs.

3. The optical module according to claim 2, wherein said housing has two clipping tabs projecting from two opposite edges facing one another.

4. The optical module according to claim 3, wherein each of said two clipping tab has three segments and two bends, and a distance between said two clipping tabs is less than the dimensions of said fan so that said fan is mounted on said heat sink by virtue of said two clipping tabs moving apart.

5. The optical module according to claim 3, wherein said two clipping tabs are inclined with respect to one another so as to facilitate insertion of said fan.

6. The optical module according claim 2, wherein each of said one or more edges has at a top at least one fan positioning member projecting from said housing in the same direction as said two clipping tabs.

7. The optical module according to claim 2, wherein said heat sink has a plurality of dissipating surfaces formed by parallel fins.

8. The optical module according to claim 7, wherein said parallel fins are separated from one another.

9. The optical module according to claim 7, wherein said parallel fins are continuous with one another to form a single piece.

10. The optical module according to claim 7, wherein said fins are made of aluminum.

11. The optical module according to claim 1, wherein said light source comprises at least one light emitting diode.

12. The optical module according to claim 1, wherein said fan is mounted on said heat sink by sliding said fan along said heat sink and then locking by clipping.

13. The optical module according to claim 12, wherein said sliding is effected through interaction between two grooves and two rails, said two grooves belonging to one of the two elements consisting of said heat sink and said fan, and said two rails belonging to the other element.

14. A heat sink for producing an optical module according to claim 1.

15. A vehicle headlamp comprising at least one optical module according to claim 1.

16. An optical module comprising:

a heat sink having one or more heat dissipating surfaces formed by an array of fins;

a fan configured to send air over said one or more heat dissipating surfaces;

a light source held by said heat sink, said fan mounted on said heat sink by clipping; and a heat sink housing configured to be mounted on and receive said heat sink; and wherein said array of fins include a fixing portion allowing the said array of fins to be fixed to said heat sink housing, said heat sink housing including a holding portion to receive said fixing portion of said array of fins.

17. The optical module according to claim 16, wherein the heat sink housing comprises one or more edges and at least two deformable clipping tabs projecting from at least one of said one or more edges, and said fan is placed on said heat sink between said at least two deformable clipping tabs.

18. The optical module according claim 17, wherein each of said one or more edges has at a top at least one fan positioning member projecting from said housing in the same direction as said two clipping tabs.

19. A vehicle headlamp comprising at least one optical module according to claim 16.

* * * * *